United States Patent [19]

Surdilla

[11] Patent Number: 5,058,779

[45] Date of Patent: Oct. 22, 1991

[54] POSITIVE DISPLACEMENT PISTON METERING PUMP

[76] Inventor: Silverio B. Surdilla, 32400 Lois Way, Union City, Calif. 94587

[21] Appl. No.: 481,946

[22] Filed: Feb. 20, 1990

[51] Int. Cl.[5] ..... B65D 88/54

[52] U.S. Cl. ..... 222/309; 222/334; 417/498; 417/501; 417/511; 417/570

[58] Field of Search ..... 222/309, 334, 409; 417/511, 570, 501, 498, 519

[56] References Cited

U.S. PATENT DOCUMENTS

| | | | |
|---|---|---|---|
| 4,484,866 | 11/1984 | Runkle | 417/501 X |
| 4,531,895 | 7/1985 | Zeck | 417/570 X |
| 4,784,584 | 11/1988 | Gruett | 417/511 X |
| 4,893,738 | 1/1990 | Gelinas | 222/309 X |
| 4,930,669 | 6/1990 | Dickau et al. | 222/309 |

*Primary Examiner*—Michael S. Huppert
*Assistant Examiner*—Gregory L. Huson
*Attorney, Agent, or Firm*—Linval B. Castle

[57] ABSTRACT

A pneumatically operated metering pump having in a single cylinder, a driven piston and a slave piston that operates as a sliding valve for admitting fluid into the pump and drawing it into the cylinder between the two pistons so the next downward stroke of the master piston will force the fluid from the discharge port.

6 Claims, 1 Drawing Sheet

FIG. 1
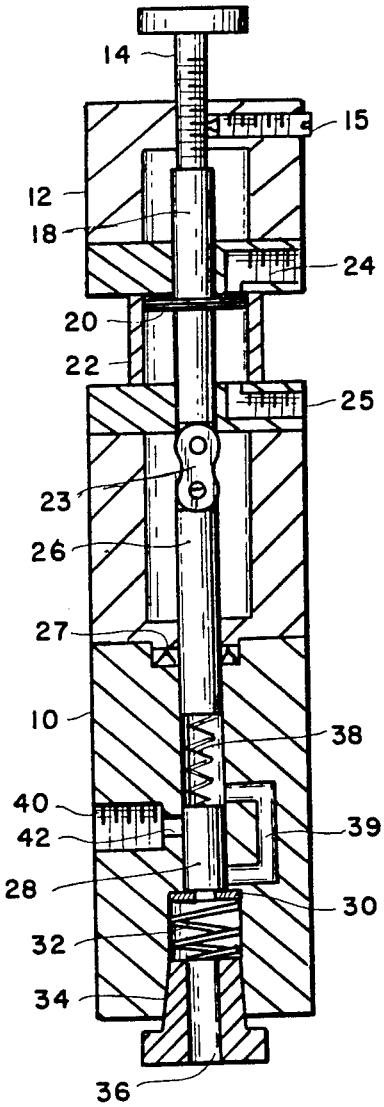
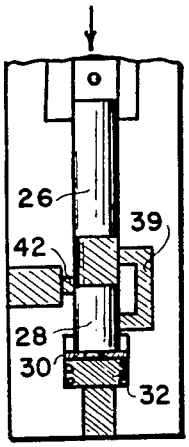
FIG. 2
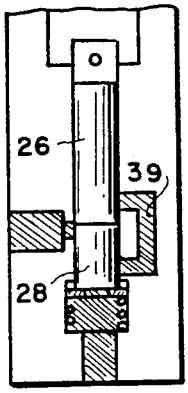
FIG. 3
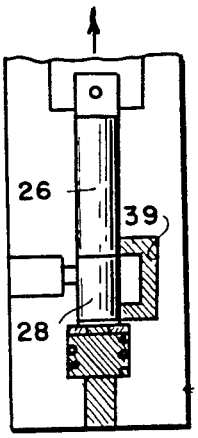
FIG. 4
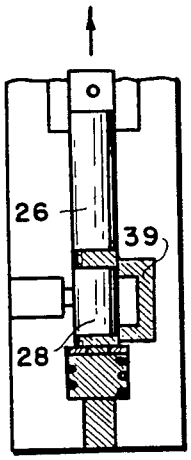
FIG. 5
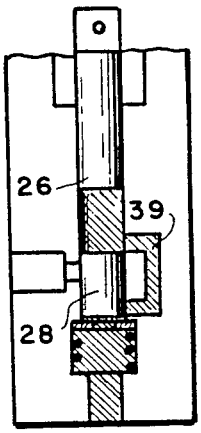
FIG. 6

POSITIVE DISPLACEMENT PISTON METERING PUMP

BRIEF SUMMARY OF THE INVENTION

This invention relates to metering pumps and in particular to a novel pneumatically operated pump for the high speed dispensing of fluids or pastes.

Pumps that can eject precise amounts of fluids at relatively high speeds are extensively used in various industries, for example, chemical metering in medical of industrial laboratories, for depositing small dots of soldering flux to a circuit board, the lubrication of various components, or for the spot welding together of plastic parts with a cement or solvent. Most metering or dispensing pumps require a controller to vary time and air pressure on a fluid piston to control the flow through each size dispensing orifice.

The pump to be described is a positive displacement piston metering pump and can provide rapid, accurate and repeatable dispensing of thin water-like fluids up to fluids having a viscosity of up to about 25,000 centipoise and at pressures up to approximately 500 psi. The metered output volume may be adjusted between 0.001 cc. to 3.2 cc. per stroke and an important feature is that the adjustment may be made during operation while the pump is actually running.

Briefly described, the metering pump includes a pneumatic operated master piston and, below that, a slave or compliant piston, both axially operating within the same axial cylinder. An axial fluid inlet port below the bottom of the compliant piston admits fluid into the cylinder and dispenses from a radial discharge port in the side of the pump body. An air cylinder near the top of the pump is coupled to reciprocate the master piston which, together with the compliant piston operating as a sliding valve, operates to draw fluid into a bypass conduit and then force it out into the discharge port. An axial adjustment screw above the air cylinder adjusts the stroke lengths and hence the volume of dispensed fluid.

DESCRIPTION OF THE DRAWINGS

In the drawings which illustrate the preferred embodiment of the invention:

FIG. 1 is a sectional view of the metering pump; and

FIGS. 2 through 6 are simplified views of the metering pump illustrating its operation as the pistons go through one cycle.

DETAILED DESCRIPTION OF THE PREFERRED EMBODIMENTS

Illustrated in FIG. 1 is the positive displacement piston metering pump comprising a tubular pump cylinder body 10 having near its top a hollow stroke adjustment block 12 with a hand rotated adjustment screw 14 axially threaded into the end and securable against accidental rotation by a rubber tipped locking screw 15. The adjustment screw 14 can extend into the block 12 to a point at which its end contacts the upper end of a axially movable piston rod 18 which carries a piston 20 in an air cylinder 22. Air ports 24, 25 are located at the top and bottom ends of the cylinder 22 for selectively admitting and exhausting air from the cylinder for providing axial movement to the air piston 20.

Cylinder 22 is a double acting, double rod air cylinder so that the piston rod 18 extends from the bottom end of the cylinder and is coupled by a flexible connecting link 23 to the top end of a master piston 26 which is slideably positioned within an axial cylindrical hole through the body 10 and which is secured against leakage by a piston rod seal 27 such as a spring energized seal. At the bottom surface of the master piston 26 is the top end of a second or compliant piston 28 which is freely movable within the axial hole and is "free-floating" and unattached. The bottom end of the compliant piston 28 normally rests on the surface of a washer 30 in an axial hole slightly greater in diameter than the piston hole and which is secured by a relatively strong retaining spring 32 held biased up against the compliant piston by a tubular connector 34 having a fluid inlet port 36 in the bottom of the body 10. A second spring 38, thinner and weaker than the spring 32, is recessed in axial openings through the interfacing surfaces of the master piston 26 and compliant piston 28 and operates to force apart the two pistons.

A fluid conduit 39 is formed in the lower portion of the body 10 by drilling a longitudinal hole parallel with, but spaced from the central axis of the body and its axial cylinder hole, and two spaced radial holes that intersect the longitudinal hole and the axial cylinder hole. Parts of the drilled holes are then permanently plugged so that only a U-shaped conduit 39 remains, as illustrated.

The positioning and spacing of the radial holes in the conduit 39 are important; the lower radial hole must open into the bottom of the wall in the axial cylinder hole, i.e. only slightly above the top surface of the washer 30; and the center-to-center spacing between the two radial holes in the conduit must equal the length of the compliant piston 28. With pistons 26 and 28 in their normal positions, as shown in FIG. 1, the lower end of the compliant piston 28 seals the lower radial hole of the conduit.

Located in a sidewall of the body 10 is a discharge port 40 having a radial opening 42 into the axial cylinder hole in the body 10. It is important that the top of the radial opening 42 be only slightly (e.g. 0.02 inches) below the top surface of the compliant piston 28 when this piston is in its normal position at the bottom of the axial cylinder hole and resting on the washer 30. In this position the upper end of the compliant piston seals the radial opening 42.

Operation

FIG. 1 illustrates the metering pump at rest in its normal position, The air piston 20 is in its top position as determined by the adjustment screw 14. The compliant piston 28 rests upon the washer 30 which is being forced up into the top of the wide portion of the axial hole through the body 10 by the spring 32. In this position, the compliant piston 28 closes the lower radial opening into the fluid conduit 39 and also the discharge port opening 42.

FIGS. 2 through 6 are schematic views of portions of the metering pump of FIG. 1 during various phases of its operation. The crosshatching shown in these figures represents the fluid in the various passages of the pump. Because of the crosshatching, the thin light spring 38 is not illustrated in FIGS. 2, 5 and 6.

In FIG. 2 the air cylinder 20 and master piston 26 are starting a downward motion. Since the compliant piston 28 had closed the conduit 39 and discharge port opening 42 in the normal at-rest position of FIG. 1, there has been no fluid escape route so that a downward force by the piston 26 forced the compliant piston to move down over the force of the spring 32 until the discharge port opening 42 is exposed. Further downstroke by the master piston forces all fluid from the cylinder between the piston interfaces.

In FIG. 3 the master piston 26 is at the bottom of its stroke. The compliant piston is also being forced up against the master piston by the spring 32 to squeeze out all fluid and entrained microair past the rod seal 27.

In FIG. 4 the piston ends are in contact with each other. The master piston 26 begins to move upward and the vacuum between the piston interfaces draws the compliant piston 28 up with the master piston, thereby drawing new fluid into the area beneath the compliant piston.

In FIG. 5 the compliant piston 28 has opened the passages into the conduit 39 thereby breaking the vacuum between the piston interfaces. The compliant piston remains in this position while the master piston 26 continues upward to draw fluid into the cylinder between the piston interfaces.

In FIG. 6 the master piston 26 has reached its topmost position as determined by the setting of the adjustment screw 14. The piston 26 can draw no more fluid into the pump and now the spring 38 between the master and compliant pistons pushes the compliant piston 28 down to seal the lower passage into the conduit 39. This is the same condition as shown in FIG. 1.

The amount of fluid dispensed from the port 40 depends upon the amount drawn into the space between the interfacing end surfaces of the master and compliant pistons, and this will depend upon the distance the master piston 26 is lifted by the air piston 20. This amount of lift is accurately determined by the adjustment of the stroke adjustment screw 14 of FIG. 1. An important feature of the pump is that the adjustment screw 14 may be accurately readjusted during operation of the pump.

I claim:

1. A fluid dispensing pump comprising;

a pump body having first and second ends and an axial hole therethrough;

a first piston axially movable in said axial hole, said first piston having first and second ends;

a second piston axially movable in said axial hole, said second piston having first and second ends, the first end of said second piston facing the second end of said first piston;

power means coupled to said first piston for axially moving said first piston toward the first and second ends of said body;

spring means acting on the second end of said second piston for urging said second end from the second end of said body;

a fluid inlet port for admitting fluid in the second end of said body and into said axial hole in the second end;

conduit means including first and second interconnected radial holes opening into said axial hole in said body, the axial center line spacing between said radial holes being equal to the the length of said second piston, the first radial hole intercepting said axial hole at a point where it may be sealed by a side surface of the second end of said second piston, the second radial hole intercepting said axial hole at a point adjacent the first end of said second piston where it may be sealed by a side surface of the second end of said first piston in its normal position; and a radial fluid discharge port through the wall of said body, said discharge port intercepting said axial hole at a point adjacent said first end of said second piston and sealable by the side surface of said second piston.

2. The pump claimed in claim 1 wherein the second end of said second piston is retained in said axial hole by a first surface of a washer having first and second surfaces, the second surface of said washer in contact with said spring means.

3. The pump claimed in claim 2 wherein said fluid inlet port is an axial port in the second end of said pump body, and wherein said spring means is retained in said axial inlet by a fluid inlet connector.

4. The pump claimed in claim 1 wherein said power means is a pneumatic piston having a double rod extending through the axis of said pneumatic piston and having first and second ends, the first end of said rod extending toward said first piston, the second end of said rod extending toward said first end of said body.

5. The pump claimed in claim 4 further including an adjustment screw in the first end of said body, the end of the threaded shaft of said screw positioned to contact the second end of said rod for adjusting the length of the stroke of said pneumatic piston and said first piston.

6. The pump claimed in claim 5 wherein the first end of said piston rod is coupled to said first piston by a pivotable connecting link.

* * * * *